US007185830B2

(12) United States Patent
Malcolm

(10) Patent No.: US 7,185,830 B2
(45) Date of Patent: Mar. 6, 2007

(54) UNIFORM DROPLET SPRAY NOZZLE FOR LIQUIDS

(76) Inventor: David B. Malcolm, 43360 Werney Rd., Coarsegold, CA (US) 93614

( * ) Notice: Subject to any disclaimer, the term of this patent is extended or adjusted under 35 U.S.C. 154(b) by 86 days.

(21) Appl. No.: 10/871,899

(22) Filed: Jun. 18, 2004

(65) Prior Publication Data

US 2005/0279863 A1 Dec. 22, 2005

(51) Int. Cl.

| | |
|---|---|
| ***B05B 1/26*** | (2006.01) |
| ***B05B 1/34*** | (2006.01) |
| ***B05B 7/12*** | (2006.01) |
| ***B05B 7/06*** | (2006.01) |

(52) U.S. Cl. ..... 239/461; 239/463; 239/469; 239/417.5; 239/424.5

(58) Field of Classification Search ..... 239/461, 239/463, 469, 473, 477, 417.5, 424.5, 433, 239/590.5, 593, 594, 595
See application file for complete search history.

(56) References Cited

U.S. PATENT DOCUMENTS 3,780,952 A * 12/1973 Huang ..... 239/424.5
4,510,874 A * 4/1985 Hasenack ..... 110/347
4,667,877 A * 5/1987 Yao et al. ..... 239/102.2
6,196,831 B1 * 3/2001 Dugue et al. ..... 431/8
6,338,439 B1 * 1/2002 Goenka et al. ..... 239/8
6,378,788 B1 * 4/2002 Skeath et al. ..... 239/424.5

* cited by examiner

*Primary Examiner*—Davis Hwu
(74) *Attorney, Agent, or Firm*—Richard A. Ryan

(57) ABSTRACT

A liquid spray nozzle configured to provide a relatively uniform droplet size spray having a nozzle body, a flow passage disposed in the nozzle body, a turbulent flow mechanism in the flow passage, a flow separating mechanism in the flow passage and a converging mechanism at the nozzle body outlet. The turbulent flow mechanism, preferably a cylindrical pin, induces turbulent flow to the fluid stream flowing through the passage. The flow separating mechanism, also preferably a cylindrical pin, separates the turbulent flow into two separate, diverging streams. The converging mechanism is configured to direct the two streams together such that the colliding thereof produces a spray made up of substantially uniform sized droplets. Preferably, the converging mechanism is an orifice plate having two outwardly extending deflecting members and a generally oval-shaped opening and the nozzle body is adapted to threadably connect to a hose or other conduit.

23 Claims, 4 Drawing Sheets

| PRESSURE (PSI) | FLOW RATE (GPM) NOZZLE "A" | NOZZLE "B" | NOZZLE "C" |
|---|---|---|---|
| 10 | 6.9 | 8.9 | --- |
| 20 | 9.0 | 12.2 | --- |
| 30 | 12.9 | 14.9 | --- |
| 40 | 14.3 | 16.5 | --- |
| 50 | 16.0 | 18.0 | --- |
| 60 | 17.0 | 20.0 | 37.6 |
| 70 | 18.0 | 21.5 | 40.7 |
| 80 | --- | 22.9 | 43.7 |
| 90 | --- | 24.3 | 46.3 |
| 100 | --- | 25.1 | 48.9 |

UNIFORM DROPLET SPRAY NOZZLE FOR LIQUIDS

CROSS-REFERENCE TO RELATED APPLICATIONS

None.

BACKGROUND OF THE INVENTION

A. Field of the Invention

The field of the present invention relates generally to liquid spray nozzles. More particularly, the present invention relates to liquid spray nozzles that are configured for use at the end of a conduit, such as a hose or pipe, for spraying liquid therefrom. Even more particularly the present invention relates to such nozzles that convert a stream of pressurized liquid into a relatively gentle spray comprising a plurality of uniformly sized droplets.

B. Background

The use of a spray nozzle at the end of a conduit, such as a hose or pipe, to convert a pressurized stream of liquid into a spray pattern has been well known for many years. Spray nozzles are commonly attached to the end of a garden or other type of hose to allow the user to convert the flowing stream into a spray pattern to more effectively distribute water over the surface on which the water is needed or desired. Spray nozzles are also commonly attached to the threaded end of a pipe or other conduit, which may be fixed in place, for use as a shower, car wash or other facility. The general objective of all such nozzles is to break up the linear stream of liquid into a spray pattern that covers more area with less pressure or impact on specific areas of the object being sprayed. For instance, when used to water lawns, gardens or turf, the use of a spray nozzle at the end of a hose has the advantage of covering the area being watered with a more gentle flow than would otherwise be obtained by merely directing the stream from the hose. As well known, without the spray nozzle, the pressurized stream of water from the hose would be concentrated in small areas that could dig or gouge out a portion of the area being watered. Although even mature vegetation could be harmed by direct application of the pressurized stream of liquid, such action would be particularly harmful for seeded or newly planted areas. It is well known that people, animals, automobiles, structures and most other objects also benefit from conversion of a pressurized stream of water to a spray pattern that prevents the stream being directed in a relatively small area of the object.

Nozzles configured for use at the end of a hose, commonly referred to as hose end nozzles, are typically provided in either a pistol-grip, barrel-type or shower head configuration. Generally, most such nozzles utilize a coupling mechanism or the like to attach to the threaded end of the hose. As the name implies, pistol-grip nozzles are typically configured with a tubular body in the shape of a pistol or like object with a handle that attaches to the hose and a trigger or lever apparatus that is squeezed to control the spray pattern and flow of water out the end of the barrel portion of the nozzle. Typically, the tighter the trigger is squeezed the more the spray pattern resembles a stream of water. The usual mechanism for controlling the spray pattern is a valve stem that is disposed in the barrel's flow channel and which moves in response to the trigger operation. Barrel-type nozzles typically have a somewhat cylindrically-shaped body that connects at one end to the hose and discharges water from an orifice at the opposite end of the body.

Generally, a portion of the nozzle is retracted, extended or twisted by the user to adjust the flow rate and spray pattern of the fluid from the orifice. Shower head nozzles typically have a mechanism for attachment to the hose and an orifice/head portion that includes a plate having a plurality of small holes to separate the single, high volume stream of water into many small streams of water. Some of these types of nozzles utilize an orifice plate having a fixed number of specifically sized open holes, while others include a mechanism that allows the user to adjust the number and/or size of open holes.

A number of limitations are known to exist with the pistol-grip, barrel-type or shower head configured hose end nozzles. One such limitation common to these nozzles is that, in general, they are not well configured for certain uses, namely high volume, low to medium pressure uses such as watering golf courses and other turfs where the volume and pressure of the water is more likely to result in streams that can cause damage to the area being watered. Nozzles which are configured to avoid this problem can be somewhat cost prohibitive for the typical user. A limitation particularly applicable to the pistol or adjustable spray twist nozzles, which makes them somewhat unsuitable for use for plant watering or animal washing, is that as the valve stem is adjusted to create stream diffusion the flow rate is significantly reduced and the diameter of the spray becomes to large for effective watering or washing. The droplets may be of fairly uniform size, but they are very small and tend to drift in the wind, thereby welting the operator (i.e., a misting effect). A limitation particularly applicable to the shower head type of nozzle is that the velocity of each individual stream coming out of the nozzle is approximately the same as that of the original larger stream, which can have a significant negative effect on young or small plants as these small streams impact the plants. Perhaps the main disadvantage of the shower head type of nozzle that the small holes tend to plug if the water is not passed through a screen before reaching the nozzle. As well known, grass, sand or other debris commonly found in the water used for watering golf courses or other turf applications (which may be from reclaimed or other secondary water sources) or which contacts the nozzle from an external source (such as the ground), can somewhat significantly plug shower head nozzles. When a portion of the nozzle becomes plugged, the unplugged portion, such as the unplugged holes in a shower head nozzle, will have to pass the same total water volume as before, but at a higher pressure. As a result, the spray from the nozzle may have locally high pressure flow coming from the nozzle when it is not desired.

Other types of devices for liquid spray include nozzles having an out-of-round or irregularly shaped orifice and deflectors used to atomize the spray. Although the out-of-round or irregularly shaped nozzles do not have the plugging problems generally associated with the shower head nozzles, the droplet size of the spray is not uniform throughout the spray pattern. For instance, droplet size may be somewhat larger in the center of the stream or at the perimeter of the spray stream. As a result, some areas of the spray have a greater impact on the plant, animal or other spray object than other areas (or more than desired). Use of deflectors is a common method of atomizing large or small volume water streams into smaller droplets. The droplets are generally very small, resulting in wind drift (misting). In addition, the shape of the spray is generally not practical for hand watering of plants, washing of animals or other hand-held spray applications.

Improved spray/droplet formation and uniform droplet size are known to be important in many types of uses for improved watering or spraying. For instance, with regard to the watering of gardens, turf or other vegetative areas, breaking the pressurized stream of water into a plurality of uniformly sized droplets will provide a more gentle spray that will have less impact force on the plants and/or turf. Further, the more uniform spreading of the water spray will allow the water to penetrate the soil quicker and reduce the deleterious effects of water run-off, including damage to the soil, turf and vegetation and waste of water. In addition, breaking the pressurized stream of water into a plurality of uniformly sized, small droplets will provide greater and more effective area coverage for the same spray effort. Most conventionally configured spray nozzles, particularly hose end spray nozzles, do not provide or even attempt to provide uniform droplet sized spray. Some nozzles have incorporated one or more turbulence producing mechanisms, such as break-up pins or other devices that create turbulent flow inside the nozzle, to improve the formation of individual water droplets upon the spray exiting the nozzle and to achieve a lower pressure spray. These nozzles have generally not been successful with regard to creating a more uniformly distributed spray of uniformly sized droplets.

What is needed, therefore, is an improved liquid spray nozzle that is more effective at breaking up a pressurized stream of liquid flow into a plurality of uniform droplets at lower pressure to provide a more gentle spray. The preferred liquid spray nozzle should be configured to be adaptable for attachment to the end of a hose or other conduit and receive the full pressurized flow of the fluid therefrom. The preferred spray nozzle should be configured to resist plugging with debris, whether from the fluid or external sources, and not form a significant amount of mist. Ideally, the preferred spray nozzle should be relatively inexpensive to manufacture, easy to use and adaptable for a variety of different uses.

SUMMARY OF THE INVENTION

The liquid spray nozzle for uniform droplet spray of the present invention solves the problems and provides the benefits identified above. That is to say, the present invention discloses a new and improved liquid spray nozzle that breaks-up a pressurized stream of fluid into a plurality of generally uniformly sized droplets for a more gentle, lower pressure and effective spray. The spray nozzle of the present invention is adaptable for attachment to the end of a conduit, such as a hose or pipe, and capable of receiving the full flow of fluid therefrom. In the preferred embodiment, the spray nozzle of the present invention is provided with a single large flow opening that will generally resist plugging from debris carried by the fluid flow or which otherwise comes in contact with the spray nozzle and substantially reduces the formation of mist. The spray nozzle of the present invention is relatively inexpensive to manufacture, easy to use and adaptable for a variety of different uses, including spraying of fields, turf, animals, vehicles and/or people.

In one aspect of the present invention, the liquid spray nozzle of the present invention is particularly configured for use with a conduit, such as a hose or pipe, having one end accessible to the spray nozzle and the other end connected to a supply of pressurized liquid, such as water. In this configuration, the spray nozzle of the present invention includes a nozzle body having an upstream end and a downstream end with a receiving section generally disposed at the upstream end and a nozzle section towards the downstream end. The receiving section can be configured with an internally threaded opening to threadably connect to a conduit, such as a hose or pipe, carrying a pressurized liquid. A flow passage, having an inlet generally towards the upstream end and an outlet at the downstream end, is disposed inside the nozzle section of the nozzle body. Disposed in the flow passage downstream of the inlet is a turbulent flow mechanism, preferably a cylindrical pin, for inducing turbulence to the flow stream to form a turbulent flow stream. In the flow passage downstream of the turbulent flow mechanism is a flow separating mechanism, also preferably a cylindrical pin, for separating the turbulent flow stream into a first separated stream and a second separated stream. Preferably, the flow separating mechanism is configured to form two diverging streams. At the outlet is a converging mechanism for directing the first separated stream and the second separated stream together. In the preferred embodiment, the converging mechanism includes an orifice plate having a first deflecting member and a second deflecting member cooperatively configured to direct the first separated stream and the second separated stream out of the oval-shaped orifice opening such that they collide together to form a substantially uniform droplet sized spray. The converging mechanism can be formed by the die stamping process. A flow control valve can be attached to the nozzle body between the receiving section and the conduit for controlling the flow and quantity of flow of the fluid from the conduit.

In an alternative configuration, the liquid spray nozzle of the present invention is configured as just the nozzle section, comprising a nozzle body having an upstream end and a downstream end, a flow passage disposed in the nozzle body, a turbulent flow mechanism for inducing turbulence to the flow stream to form a turbulent flow stream, a flow separating mechanism for separating the turbulent flow stream into a first separated stream and a second separated stream, and a converging mechanism for directing the first separated stream and the second separated stream together such that they collide to form a substantially uniform droplet sized spray. In the preferred embodiment, the turbulent flow mechanism and flow separating mechanism are generally cylindrical pins disposed perpendicularly, relative to the flow passage and each other, in the flow passage near the downstream end of the nozzle body. The flow separating mechanism is configured to form two diverging streams that contact the converging mechanism, which is formed from two outwardly extending deflecting members on an orifice plate mounted at the downstream end of the nozzle body.

Accordingly, the primary objective of the present invention is to provide a liquid spray nozzle that provides the advantages discussed above and that overcomes the disadvantages and limitations associated with presently available liquid spray nozzles.

It is also an object of the present invention to provide a liquid spray nozzle that breaks-up a pressurized stream of fluid flow into a lower pressure spray comprised of a plurality of uniformly sized droplets that produce a relatively gentle spray for use on turf, vegetation, animals, people, vehicles or other spray objects.

It is also an object of the present invention to provide a liquid spray nozzle adaptable for connection to the end of a conduit, such as hose or pipe, to receive the full flow of the fluid therefrom and break-up the fluid into a spray comprised of a plurality of uniformly sized droplets.

It is also an object of the present invention to provide a liquid spray nozzle for producing uniform droplet sized spray that is generally resistant to plugging from grass, soil, sand and other debris.

It is also an object of the present invention to provide a liquid spray nozzle for producing uniform droplet sized spray that includes an inlet, a flow passage, a mechanism in the flow passage downstream of the inlet for creating turbulent flow, a mechanism for separating the turbulent flow into at least two flow steams and a mechanism at or near the outlet for converging the two streams to create the generally uniform droplet sized spray.

It is also an object of the present invention to provide a liquid spray nozzle for producing uniform droplet sized spray that includes an inlet, a flow passage, a first pin in the flow passage downstream of the inlet for creating turbulent flow, a second pin in the flow passage generally near the outlet for separating the turbulent flow into at least two flow steams and an orifice plate having a pair of deflecting members at or near the outlet for converging the two streams to create the generally uniform droplet sized spray.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
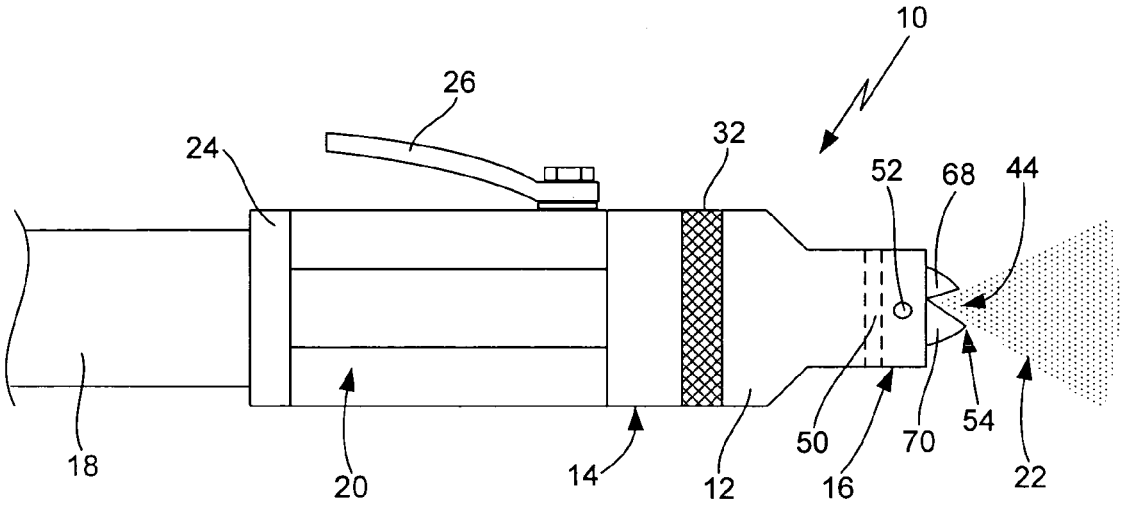
FIG. 1 is a side view of a liquid spray nozzle configured according to a preferred embodiment of the present invention shown in use with a flow control valve and a conduit to spray water or other liquids in a uniformly sized droplet spray.

With reference to the figures where like elements have been given like numerical designations to facilitate the reader's understanding of the present invention, and particularly with reference to the embodiments of the liquid spray nozzle of the present invention illustrated in the figures, various preferred embodiments of the present invention are set forth below. The enclosed description and drawings are merely illustrative of preferred embodiments and represent several different ways of configuring the present invention. Although specific components, materials, configurations and uses of the present invention are illustrated and set forth in this disclosure, it should be understood that a number of variations to the components and to the configuration of those components described herein and in the accompanying figures can be made without changing the scope and function of the invention set forth herein.

In the preferred embodiment of the liquid spray nozzle of the present invention, shown in the figures, the spray nozzle is identified generally as 10. As best shown in the FIGS. 1 and 2, the preferred spray nozzle 10 has a nozzle body 12 having an upstream end 14 and a downstream end 16. In the preferred embodiment, upstream end 14 is configured to attach to a conduit 18, either directly or with a flow control valve 20 disposed therebetween (as shown), and downstream end 16 is configured to discharge the desired spray of water, shown generally as 22. As known to those skilled in the art, conduit 18 may be any type of tubular member, including hoses, pipes, tubes and the like, configured to carry a pressurized liquid, such as water. The end of conduit 18 opposite that to which spray nozzle 10 attaches connects to a supply of pressurized water, not shown, such as a domestic or industrial water supply system, well, tank or other source of water (i.e., typical golf course supply is at 80 psi). In a preferred use of the present invention, shown in FIG. 1 with flow control valve 20, conduit 18 is a hose, such as a garden or watering hose, and spray nozzle 10 attaches to a connector 24 having a threaded end at the end of hose 18. Flow control valve 20 can be any one of a variety of such valves commonly available, such as the full flowing configuration with the open/close handle 26 shown in FIG. 1 that is operated to shut-off or allow the full flow of water from conduit 18 to spray nozzle 10. Other configurations for flow control valve 20, such as those allowing adjustable flow rates, can also be utilized with spray nozzle 10 of the present invention.

Figure 2:
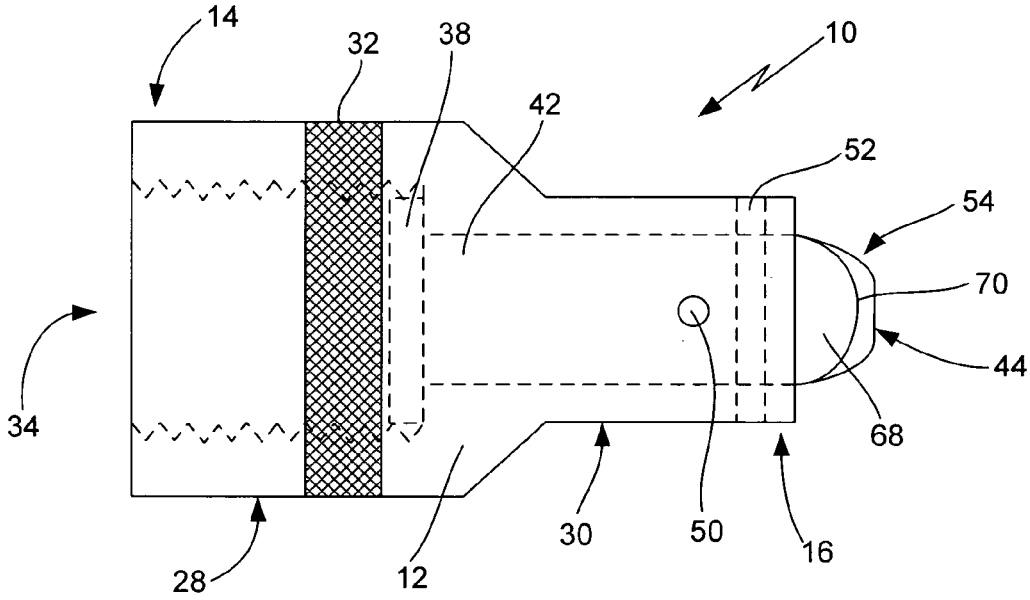
FIG. 2 is a side view of the liquid spray nozzle of FIG. 1.
Figure 3:
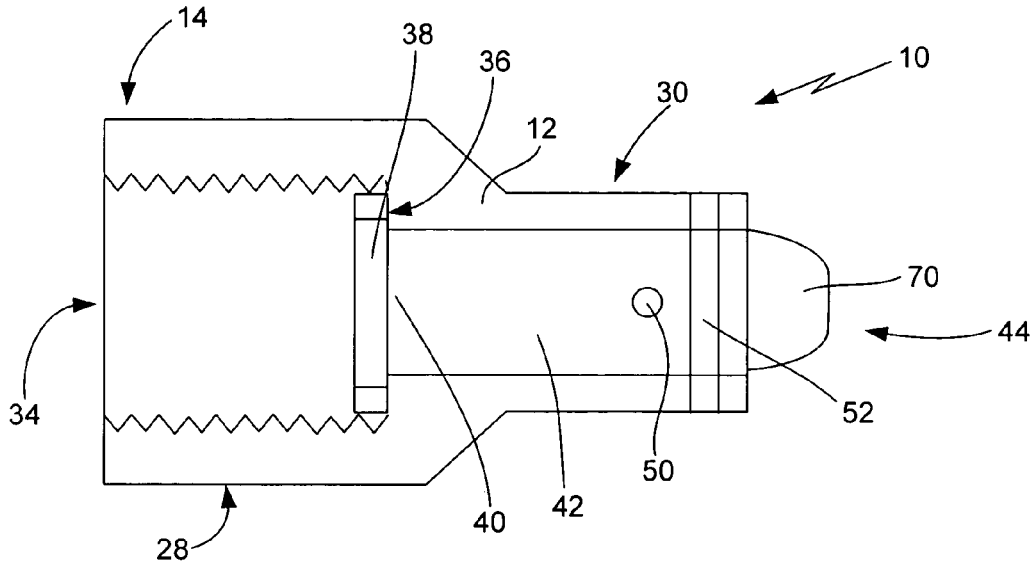
FIG. 3 is a cross-sectional side view of the embodiment of the liquid spray nozzle of the present invention of FIG. 1.
Figure 5:
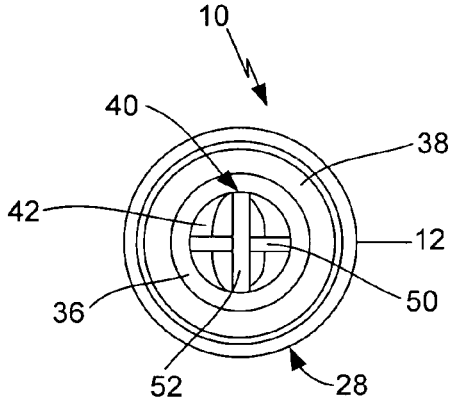
FIG. 5 is a bottom view of the liquid spray nozzle of FIG. 1.

As best shown in FIGS. 2 and 3, nozzle body 12 of the preferred embodiment of spray nozzle 10 is configured with a receiver section 28 generally towards upstream end 14 and a nozzle section 30 generally towards downstream end 16. The external surface of receiver section 28 has a tool gripping area 32 for use with a wrench, pliers or other tool to facilitate tightening to or loosening from conduit 18. As known to those skilled in the art, tool gripping area 32 can be configured with a rough finish to facilitate the gripping action of such tools and resist damage to nozzle body 12. Alternatively, or in addition to, tool gripping area 32 can be shaped with wrench flats (not shown) to facilitate use of appropriately sized wrenches. In the preferred embodiment, receiver section 28 has an internally threaded opening 34 at upstream end 14 that is configured to be threaded onto the external threaded end utilized with most hoses and pipes. As shown in FIGS. 3 and 5, disposed inside opening 34 against shoulder 36 is a sealing member 38, such as a rubber o-ring, to insure a substantially watertight seal between spray nozzle 10 and conduit 18 or flow control valve 20. At shoulder 36, opening 34 hydraulically connects to inlet 40 of longitudinal flow passage 42, which passes substantially along the longitudinal axis of nozzle section 30 to outlet 44 at downstream end 16. Water or other liquid from conduit 18 or flow control valve 20 enters spray nozzle 10 at opening 34, enters flow passage 42 at inlet 40, flows through flow passage 42 and then is discharged through outlet 44 to spray on the desired spray area.

As known to those skilled in the art, nozzle body 12 can be made out of a variety of materials, shapes and sizes. For industrial or other heavy duty uses, it is preferred that nozzle body 12 is made out of a strong, durable and corrosion resistant material, such as brass or other non-corrosive reasonable cost metals. If a less expensive spray nozzle 10 is desired, nozzle body can be manufactured out of a variety of non-metallic materials, including plastics, composites and the like. Preferably, any such materials should be selected to withstand likely impact forces (i.e., from being dropped on or hit against another object) and sufficiently corrosion and/or ultraviolet light resistant for its intended purpose. Although it is generally preferred to manufacture nozzle body 12 as an integral unit, receiver section 28 and nozzle section 30 can be made as separate components that are then fixedly joined together to form nozzle body 12.

Figure 6:
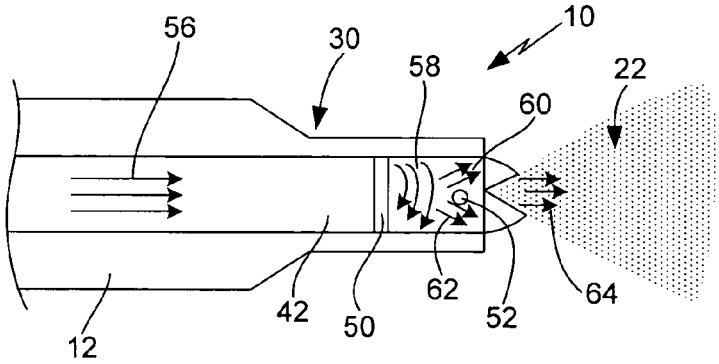
FIG. 6 is a side cross-sectional view of spray nozzle configured according to a preferred embodiment of the present invention showing the flow of liquid therethrough.

To obtain the desired uniform droplet spray 22 from spray nozzle 10 of the present invention, flow passage 42 downstream of inlet 40 in nozzle section 30 includes a turbulent flow mechanism 50, a flow separating mechanism 52 and a converging mechanism 54. As set forth in more detail below and shown in FIG. 6, turbulent flow mechanism 50 imparts turbulent movement to the liquid flowing through flow passage 42 (which is generally a linear flow 56 in conduit 18), flow separating mechanism 52 divides the turbulent flow 58 into two separate, divergent flow streams 60 and 62 and converging mechanism 54 direct the two flow streams back together such that the crashing of water into each other, shown as 64, creates the desired uniform droplet size spray 22. In the preferred embodiment, converging mechanism 54 is located at downstream end 16 where it directs the two streams of water 60 and 62, or other liquid, exiting outlet 44 towards each other, flow separating mechanism 52 is located immediately upstream of downstream end 16 just prior outlet 44 and turbulent flow mechanism 50 is positioned just upstream of flow separating mechanism 52.

As known to those skilled in the art, turbulent flow mechanism 50 can be one of many different types of available configurations that are sufficient to impart turbulent flow 58 to a pressurized liquid stream. In the preferred embodiment, as shown in FIGS. 1 and 3, turbulent flow mechanism 50 is a cylindrical pin or pin-like member that spans perpendicularly across flow passage 42 from one side of the wall of nozzle body 12 to the other. Although other devices are suitable for turbulent flow mechanism 50, which are well known in the art, ease of manufacturing suggests the use of the generally cylindrical pin. As known to those skilled in the art, a hole can be provided in the walls of nozzle body 12 at the desired location and the pin can be inserted therein to span across flow passage 42 and create the desired turbulent flow 58 when pressurized liquid flows therethrough. Generally, it is desirable that turbulent flow mechanism 50 be located somewhat close to flow separating mechanism 52 such that the when the flow is separated thereby into streams 60 and 62, it is still in a turbulent condition. Although turbulent flow mechanism 50 could be made out of a variety of different materials, it is preferred that it be sufficiently resistant to corrosion and flow forces to provide a useful life for spray nozzle 10. In a preferred embodiment, turbulent flow mechanism 50 is a stainless steel pin. The above-described turbulent flow mechanism 50 is utilized in addition to the turbulence formed by the sharp edge at shoulder 36 leading from the internally threaded opening 34 to inlet 40 and the "back pressure" formed from the placement of the converging mechanism 54 at outlet 44, both of which are known to aerate flow stream 56.

In the preferred embodiment, as best shown in FIGS. 2 and 3, flow separating mechanism 52 is also a generally cylindrical pin that is inserted through opposing holes in nozzle body 12 perpendicularly across flow passage 42 near downstream end 16. As shown in the figures, the cylindrical pin of flow separating mechanism 52 is rotated 90° relative to the cylindrical pin of turbulent flow mechanism 50 (such that the two pins are in a substantially cross-shaped configuration) and is positioned to be substantially inline or parallel to the split (described below) in converging mechanism 54. To obtain the complete desired effect of spray nozzle 10 it is necessary that flow separating mechanism 52 form two separate, diverging streams 60 and 62 of turbulent flow (i.e., not parallel streams). Although parallel streams could obtain some of the benefits, fully separated, divergent streams will better cooperate with converging mechanism 54, as described in more detail below. As known to those skilled in the art, various other devices instead of a cylindrical pin could be utilized as flow separating mechanism 52. For instance, flow separating mechanism 52 could be a flat metal piece or it could have a rectangular, square, triangular, wedge or other shape of cross-section. However, the present inventor has found that a cylindrically shaped pin has the advantage of actually separating, as opposed to splitting the stream such that it would reform as a single stream, the turbulent flow into two streams 60 and 62. As with the turbulent flow mechanism 50, flow separating mechanism 52 can also be made out of a variety of different materials, it is preferred that it be sufficiently resistant to corrosion and flow forces to provide a useful life for spray nozzle 10. In a preferred embodiment, flow separating mechanism 52 is a stainless steel pin.

Figure 4:
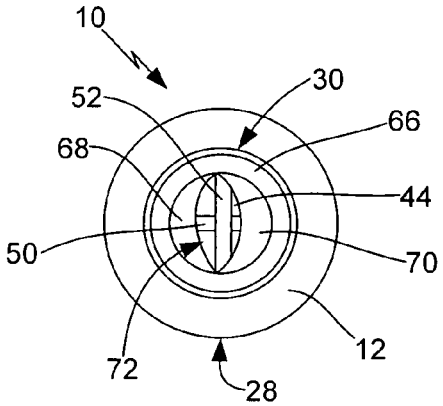
FIG. 4 is a top view of liquid spray nozzle of FIG. 1.

As discussed above, converging mechanism 54 is configured to direct the two separated streams 60 and 62 formed by flow separating mechanism 52 back towards each other so that they crash into one another, as shown as 64, to establish the desired uniform drop size spray 22. As best shown in FIGS. 1, 2 and 4, converging mechanism 54 of the preferred embodiment comprises an orifice plate 66 having a pair of outwardly extending, somewhat concave deflecting members, first deflecting member 68 and second deflecting member 70 that form orifice opening 72 from which the spray 22 exits spray nozzle 10. As best shown in FIG. 4, the preferred orifice opening 72 is a somewhat oval shape configuration and first 68 and second 70 deflecting members are cooperatively configured to direct the first separated stream 60 and second separated stream 62 together. Although round, rectangular, square or other shaped openings could be utilized, it is believed they would not work as well as the generally oval-shaped configuration. In the preferred embodiment, converging mechanism 54 is manufactured such that first deflecting member 68 and second deflecting member 70 are integral with said orifice plate 66 and one of the deflecting members (i.e, second deflecting member 70 shown in the figures) extends slightly further outward than the other deflecting member (i.e., first deflecting member 68). However, first deflecting member 68 and second deflecting member 70 can be separate components mounted directly to or near outlet 44 at downstream end 16 of nozzle body 12. The inventor has found that having orifice opening 72 slightly off-center provides an improved colliding or crashing effect and, therefore, improved uniform droplet spray 22 formation. This can be achieved with the manufacturing process for converging mechanism 54 described below. As known to those skilled in the art, outlet 44 at downstream end 16 of nozzle body 12 can be folded over or otherwise adapted to securely attach orifice plate 66 to nozzle body 12. As with the pins used for turbulent flow mechanism 50 and flow separating mechanism 52, converging mechanism 54 can also be made out of a variety of different materials. As with those components, however, it is preferred that the selected material be sufficiently resistant to corrosion and flow forces to provide a useful life for spray nozzle 10. In a preferred embodiment, converging mechanism is made out of stainless steel or like materials.

Figures 7, 8:
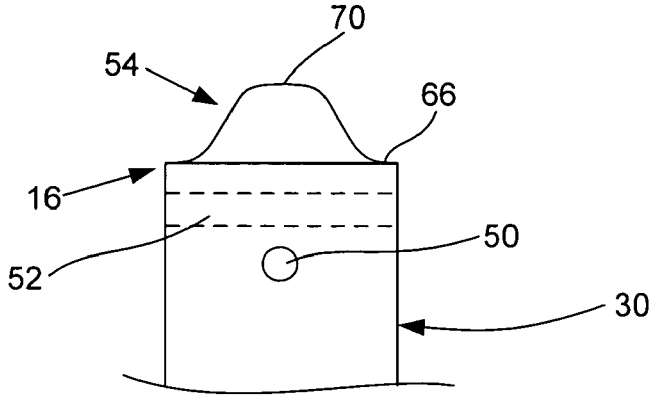
FIG. 7 is a cross-sectional view of the downstream end of the spray nozzle of the present invention showing a profile of the second deflecting member.
FIG. 8 is a table showing the pressure and flow characteristics of the spray nozzle of the present invention for three different nozzle configurations.

In the preferred embodiment, converging mechanism 54 is manufactured from stainless steel material 0.024 inches thick that is provided in a two inch wide coil format using a process known as a die-drawn process. Near the center of where orifice plate 66 will be cut out of the coil, a punch creates a slit approximately 0.516 to 0.718 inches long. In the preferred embodiment, the slit is approximately 0.020 inches off center. A die punch pushes out the stainless steel material in a generally oval-shaped cone, at an angle of approximately 60°, having the edges of orifice opening 72 at the bottom of the cone to form first 68 and second 70 deflecting members, as best shown in FIG. 4. With the slit slightly off center, one of the deflecting members (i.e., second deflecting member 70 as shown in FIG. 2) will extend outwardly slightly further than the other deflecting member (i.e., first deflecting member 68). In the preferred embodiment, the very tip of the first 68 and second 70 deflecting members is cut off to create a somewhat flattened top profile, as shown in FIG. 7 (which is a cross-sectional view of the side of second deflecting member 70). The inventor has found that although a rounded tip for first 68 and second 70 deflecting members does achieve the objectives of the present invention, the flattened tip is more effective at achieving the desired spray 22.

As discussed above, the present invention is particularly useful for high volume, low to medium pressure flows, as are typically found in domestic and industrial (i.e., golf courses, large turf areas, etc.) pressurized water sources. Different flow rates, for the same pressure, can be achieved by varying the size of the components of spray nozzle 10. While it is generally preferred to maintain consistent sizing for receiver section 28 due to the need to connect to standard sized conduits 18, the size of the components for nozzle section 30 can be varied to obtain the desired results. As shown on FIG. 8 for three different variations of spray nozzle 10, the size (i.e., diameter) of flow passage 42 and the width across orifice opening 72 of orifice plate 66 are varied to obtain different flow characteristics of spray nozzle 10. For nozzle "A" the flow passage 42 diameter is 0.406 inches and orifice opening 72 has a width of 0.516 inches with a cone diameter of 0.460 inches. For nozzle "B" the flow passage 42 diameter is 0.406 inches and orifice opening 72 has a width of 0.516 inches with a cone diameter of 0.540 inches. For nozzle "C" the flow passage 42 diameter is 0.540 inches and orifice opening 72 has a width of 0.718 inches with a cone diameter of 0.690 inches. As known to those skilled in the art, other combinations of components can result in different flow rates at different fluid pressures.

In use, spray nozzle 10 of the preferred embodiment is provided with receiver section 28 that is configured to thread onto the typical hose, pipe or other conduit 18 that can be utilized to spray turf, landscaping, people, animals, vehicles and numerous other objects. The user threads spray nozzle 10 onto the threaded end of conduit 18, with or without flow control valve 20 disposed between spray nozzle 10 and conduit 18. Once attached, the user merely aims the end of nozzle section 30 towards the desired spray target. Water flowing through conduit 18 and into spray nozzle 10 will enter flow passage 42 at inlet 40 and flow into turbulent flow mechanism 50, such as the cylindrical pin shown in the figures, which will impart turbulence to the flow stream 56. The turbulent flow stream 58 impacts flow separating mechanism 52, such as the cylindrical pin shown in the figures, and be separated into two generally divergent streams 60 and 62. These two streams of water 60 and 62 contact converging mechanism 54, comprised of orifice plate 66 having first deflecting member 68 and second deflecting member 70 extending outwardly therefrom, to cause the two streams 60 and 62 to be directed together where the crashing effect 64 will result in the formation of a plurality of uniformly sized droplets (i.e., millions of droplets) that form the desired very aerated, high volume but gentle spray 22 (i.e., rain-like droplets of uniform size). The single orifice opening 72 will resist plugging from debris carried by the water in conduit 18 or which is the result of contact with the ground or other surfaces. With nozzle body 12 is manufactured out of brass and turbulent flow mechanism 50, flow separating mechanism 52 and converging mechanism 54 made out of stainless steel, the resulting spray nozzle 10 will be both generally corrosion resistant and durable for many types of uses. The use of the cylindrical pins of turbulent flow mechanism 50 and flow separating mechanism 52 facilitates the formation of the uniform droplets as spray 22 exits spray nozzle 10 at orifice opening 72. Without these pins, or other turbulent flow mechanism 50 and flow separating mechanism 52, the droplet effect would occur (i.e., due to air and gravity effects) much further away from spray nozzle 10. Having the droplet effect occur close to spray nozzle 10 is particularly beneficial when it is utilized for landscaping, as a human shower, spraying animals and many other uses. For instance, the spray nozzle 10 of the present invention is particularly useful for spraying newly seeded areas where it is important not to disturb (i.e., move) the seeds.

Figure 9:
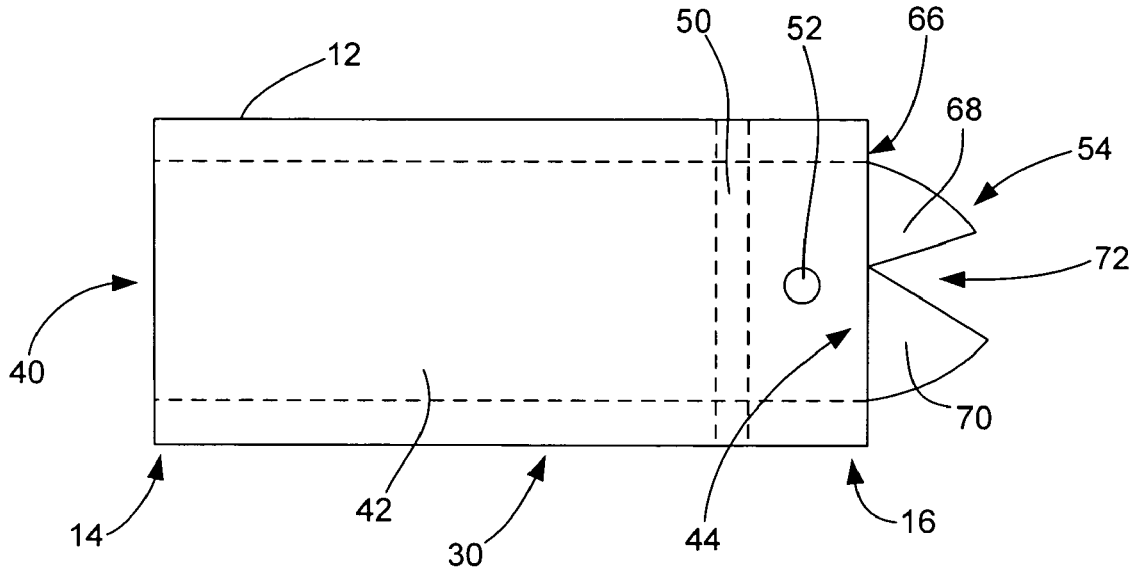
FIG. 9 is a side view of an alternative embodiment of the present invention comprising just the nozzle section of the spray nozzle shown in FIG. 1.

In an alternative embodiment, shown in FIG. 9, spray nozzle 10 of the present invention comprises primarily just nozzle section 30 discussed above. In this embodiment, spray nozzle 10 has inlet 40 at upstream end 14 and outlet 44 at downstream end 16. As before, inlet 40 allows the stream of liquid 56 to flow into flow passage 42 to turbulent flow mechanism 50 to form turbulent flow 58 and flow separating mechanism 52 to form separate, diverging streams 60 and 62 at or near downstream end 16. At downstream end 16 converging mechanism 54 directs the two streams 60 and 62 together, shown as 64, to form the preferred substantially uniform droplet size spray 22. In the preferred embodiment of this configuration, turbulent flow mechanism 50, flow separating mechanism 52 and converging mechanism 54 are as described above for the preferred (i.e., hose end) embodiment of the present invention. In this alternative embodiment, spray nozzle 10 can be attached to a variety of different types of mechanisms for spray water or other liquids. For instance, this spray nozzle 10 can be attached to the barrel as the nozzle for a pistol-type of spray gun. One or more of this spray nozzle 10 can be attached to a conduit to create a spray system wherein animals or other objects are placed to spray the object with the preferred gentle, uniform droplet sized spray 22 that is obtained with the spray nozzle 10 of the present invention. As with the preferred embodiment, this alternative embodiment is useful where-it is desired to provide a high volume of water as quickly as possible but with a relatively soft spray.

Figure 10:
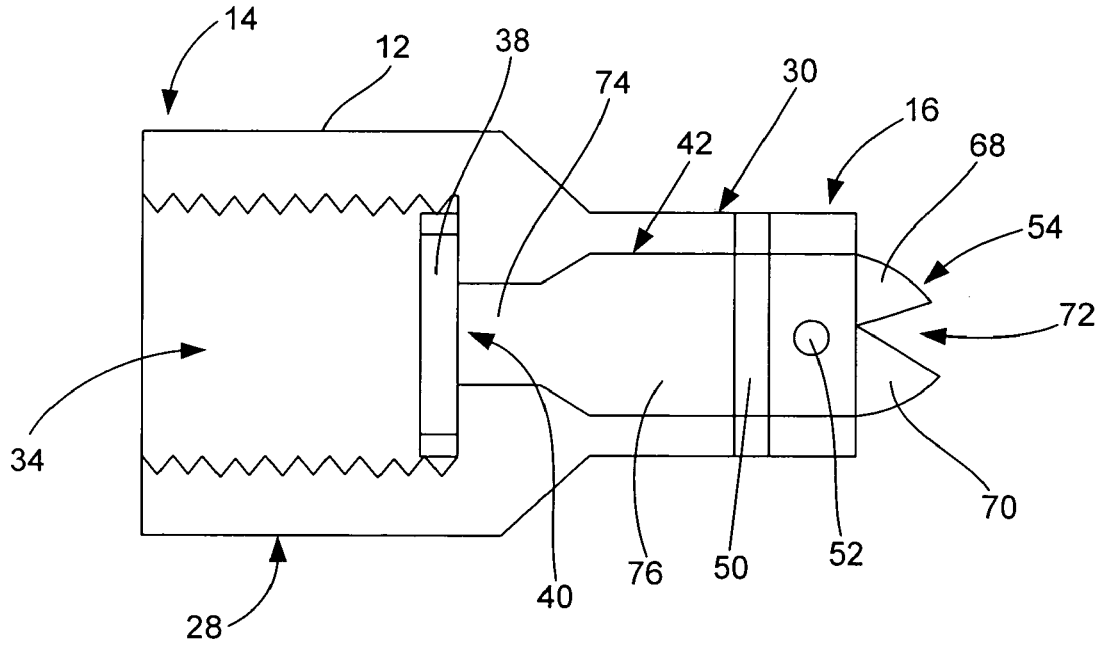
FIG. 10 is a cross-sectional side view of an alternative embodiment of the liquid spray nozzle of the present invention showing the use of multiple chambers inside the spray nozzle body.

In another alternative embodiment of the spray nozzle 10 of the present invention, shown in FIG. 10, flow passage 42 is provided with one or more additional mechanisms to form turbulent flow prior to flow separating mechanism 52. As discussed above turbulent flow mechanism 50 is utilized in addition to the turbulence formed by the sharp edge at shoulder 36 leading from the internally threaded opening 34 to inlet 40 and the "back pressure" formed from the placement of the converging mechanism 54 at outlet 44, both of which are known to aerate flow stream 56. In the alternative embodiment shown in FIG. 10, flow nozzle 10 comprises a narrow first flow chamber 74 and a second flow chamber 76 in flow passage 42. Inlet 40 opens into first flow chamber 74, which then opens into second flow chamber 76 to flow to turbulent flow mechanism 50, flow separating mechanism 52 and converging mechanism 54 discussed above. As known to those skilled in the art, turbulence will be formed in the fluid flowing from first flow chamber 74 to second flow chamber 76, further aerating fluid flow 56 prior to turbulent flow mechanism 50.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to assembly, materials, size, shape and use. For instance, some of the components described above can be made integral with each other to reduce the number of separate components.

What is claimed is:

1. A liquid spray nozzle, comprising:

a nozzle body having an upstream end and a downstream end;

a flow passage disposed in said nozzle body, said flow passage having an inlet generally towards said upstream end and an outlet at said downstream end, said flow passage adapted to carry a liquid flow stream;

means disposed in said flow passage for inducing turbulence into said liquid flow stream to form a turbulent flow stream;

means disposed in said flow passage downstream of said turbulence inducing means for separating said turbulent flow stream into a first separated stream and a second separated stream; and means at said downstream end downstream of said separating means for converging said first separated stream and said second separated stream, said converging means configured to direct said first separated stream and said second separated stream to collide together to form a substantially uniform droplet sized spray.

2. The liquid spray nozzle according to claim 1, wherein said turbulence inducing means is located generally near said downstream end of said nozzle body.

3. The liquid spray nozzle according to claim 1, wherein said turbulence inducing means is a generally cylindrical pin.

4. The liquid spray nozzle according to claim 1, wherein said separating means is configured such that said first separated stream and said second separated stream are substantially diverging prior to said converging means.

5. The liquid spray nozzle according to claim 4, wherein said separating means is a generally cylindrical pin.

6. The liquid spray nozzle according to claim 1, wherein said nozzle body further comprises a receiving section at said upstream end configured to connect to a conduit carrying a pressurized liquid.

7. The liquid spray nozzle according to claim 6, wherein said receiving section comprises an internally threaded opening hydraulically connected to said flow passage.

8. The liquid spray nozzle according to claim 6, wherein said receiving section connects to a flow control valve disposed between said nozzle body and said conduit.

9. The liquid spray nozzle according to claim 1, wherein said nozzle body is attached to or integral with a flow control valve.

10. The liquid spray nozzle according to claim 1, wherein said converging means comprises a first deflecting member and a second deflecting member, said first deflecting member and said second deflecting cooperatively configured to direct said first separated stream and said second separated stream together.

11. The liquid spray nozzle according to claim 10, wherein said converging means comprises an orifice plate having an orifice opening, said first deflecting member and said second deflecting member attached to or integral with said orifice plate and extending outwardly therefrom.

12. The liquid spray nozzle according to claim 11, wherein said orifice plate is fixedly mounted to said downstream end of said nozzle body.

13. The liquid spray nozzle according to claim 11, wherein said orifice opening is generally oval shaped.

14. The liquid spray nozzle according to claim 11, wherein said orifice opening, said first deflecting member and said second deflecting member are formed by a die-drawn process.

15. A liquid spray nozzle, comprising:

a nozzle body having an upstream end and a downstream end;

a flow passage disposed in said nozzle body, said flow passage having an inlet generally towards said upstream end and an outlet at said downstream end, said flow passage adapted to carry a liquid flow stream;

means disposed in said flow passage generally near said downstream end of said nozzle body for inducing turbulence into said liquid flow stream to form a turbulent flow stream;

means disposed in said flow passage downstream of said turbulence inducing means for separating said turbulent flow stream into a first separated stream and a second separated stream, said separating means configured such that said first separated stream and said second separated stream are substantially diverging prior to said converging means; and means at said downstream end downstream of said separating means for converging said first separated stream and said second separated stream, said converging means having a first deflecting member and a second deflecting member cooperatively configured to direct said first separated stream and said second separated stream to collide together to form a substantially uniform droplet sized spray.

16. The liquid spray nozzle according to claim 15, wherein said turbulence inducing means is a generally cylindrical first pin and said separating means is a generally cylindrical second pin.

17. The liquid spray nozzle according to claim 15, wherein said nozzle body further comprises a receiving section at said upstream end configured to connect to a conduit carrying a pressurized liquid.

18. The liquid spray nozzle according to claim 15, wherein said converging means comprises an orifice plate having an orifice opening, said first deflecting member and said second deflecting member attached to or integral with said orifice plate and extending outwardly therefrom.

19. A liquid spray nozzle, comprising:

a nozzle body having an upstream end and a downstream end, said nozzle body having a receiving section at said upstream end configured to connect to a conduit carrying a pressurized liquid;

a flow passage disposed in said nozzle body, said flow passage having an inlet generally towards said upstream end and an outlet at said downstream end, said flow passage adapted to carry a liquid flow stream;

means disposed in said flow passage for inducing turbulence into said liquid flow stream to form a turbulent flow stream;

means disposed in said flow passage downstream of said turbulence inducing means for separating said turbulent flow stream into a first separated stream and a second separated stream; and means at said downstream end downstream of said separating means for converging said first separated stream and said second separated stream, said converging means having a first deflecting member and a second deflecting member cooperatively configured to direct said first separated stream and said second separated stream to collide together to form a substantially uniform droplet sized spray.

20. The liquid spray nozzle according to claim 19, wherein said separating means is configured such that said first separated stream and said second separated stream are substantially diverging prior to said converging means.

21. The liquid spray nozzle according to claim 19, wherein said turbulence inducing means is a generally cylindrical first pin and said separating means is a generally cylindrical second pin.

22. The liquid spray nozzle according to claim 19, wherein said converging means comprises an orifice plate having an orifice opening, said first deflecting member and said second deflecting member attached to or integral with said orifice plate and extending outwardly therefrom.

23. The liquid spray nozzle according to claim 22, wherein said orifice opening is generally oval shaped.

* * * * *